United States Patent [19]

Dickey

[11] 4,260,135

[45] Apr. 7, 1981

[54] EASY PULL CLAWED TOOL REST

[75] Inventor: Avis M. Dickey, South Milford, Ind.

[73] Assignee: Dickey, Inc., South Milford, Ind.

[21] Appl. No.: 110,659

[22] Filed: Oct. 25, 1979

Related U.S. Application Data

[63] Continuation of Ser. No. 939,290, Sep. 5, 1978.

[51] Int. Cl.[3] ..... B66F 1/00

[52] U.S. Cl. ..... 254/1; 254/26 R

[58] Field of Search ..... 254/1, 25–27, 254/104; 145/61 C

[56] References Cited

U.S. PATENT DOCUMENTS

| | | | |
|---|---|---|---|
| 704,883 | 7/1902 | Ketler et al. | 254/27 |
| 1,485,863 | 3/1924 | McLain | 254/27 |
| 2,747,835 | 5/1956 | Belgard | 254/26 R |

*Primary Examiner*—Robert C. Watson

[57] ABSTRACT

A new invention of an easy pull clawed tool rest for removing nails, brads, tacks, spikes, etc., is disclosed wherein the size measures four inches in base length, $1\frac{3}{4}$ inches in width, and $1\frac{1}{2}$ inches in height at its thickest end, said vertical height rounding to meet the $\frac{1}{8}$ inch height of the opposite base end in an arc determined by a connecting portion of a 6 inch radius circle. Indents of $\frac{3}{4}$ inch width and $\frac{1}{4}$ inch depth begin at the $1\frac{1}{2}$ inch vertical height midway between base and top surface and run parallel to the base toward the $\frac{1}{8}$ inch height for a length of $1\frac{1}{4}$ inches, providing grip depressions for thumb and fingers of user. The rest shall be of molded 75 to 80 durometer neoprene rubber or comparable material which reduces possibility of surface marring to the maximum when the rest is used, while at the same time functioning well in the purpose for which it is intended.

1 Claim, 3 Drawing Figures

EASY PULL CLAWED TOOL REST

This application is a continuation of 939,290, Sept. 5, 1978.

SUMMARY OF THE INVENTION

The primary object of the invention is to provide an inexpensive, easy to use, easily transported, marreducing rest for clawed tools, the arcking top surface of which enables clawed tools to roll up for ease of removal of nails, brads, tacks, spikes, etc., when the rest is placed with the $\frac{1}{8}$ inch height end at right angle to and in close proximity with the object to be removed. The claws of the tool are slipped beneath the head of the object to be removed and rolled backward up the rest arc. Spike removal is begun in this manner, the rest then reversed wherein the $1\frac{1}{2}$ inch vertical height is adjacent to and at right angle to the half-pulled spike, enabling the clawed tool to roll down the surface arc for easy completion of the spike removal.

Further objects and advantages of the invention will appear from the following detailed description of preferred embodiments thereof and from the accompanying drawings.

DESCRIPTION OF THE PREFERRED EMBODIMENTS

Figure 1:
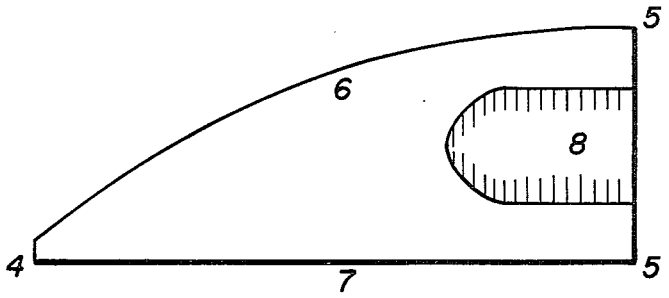
FIG. 1 is a planned side view of the invention, proportion and size of which are of like measurement to the invention.
Figure 2:
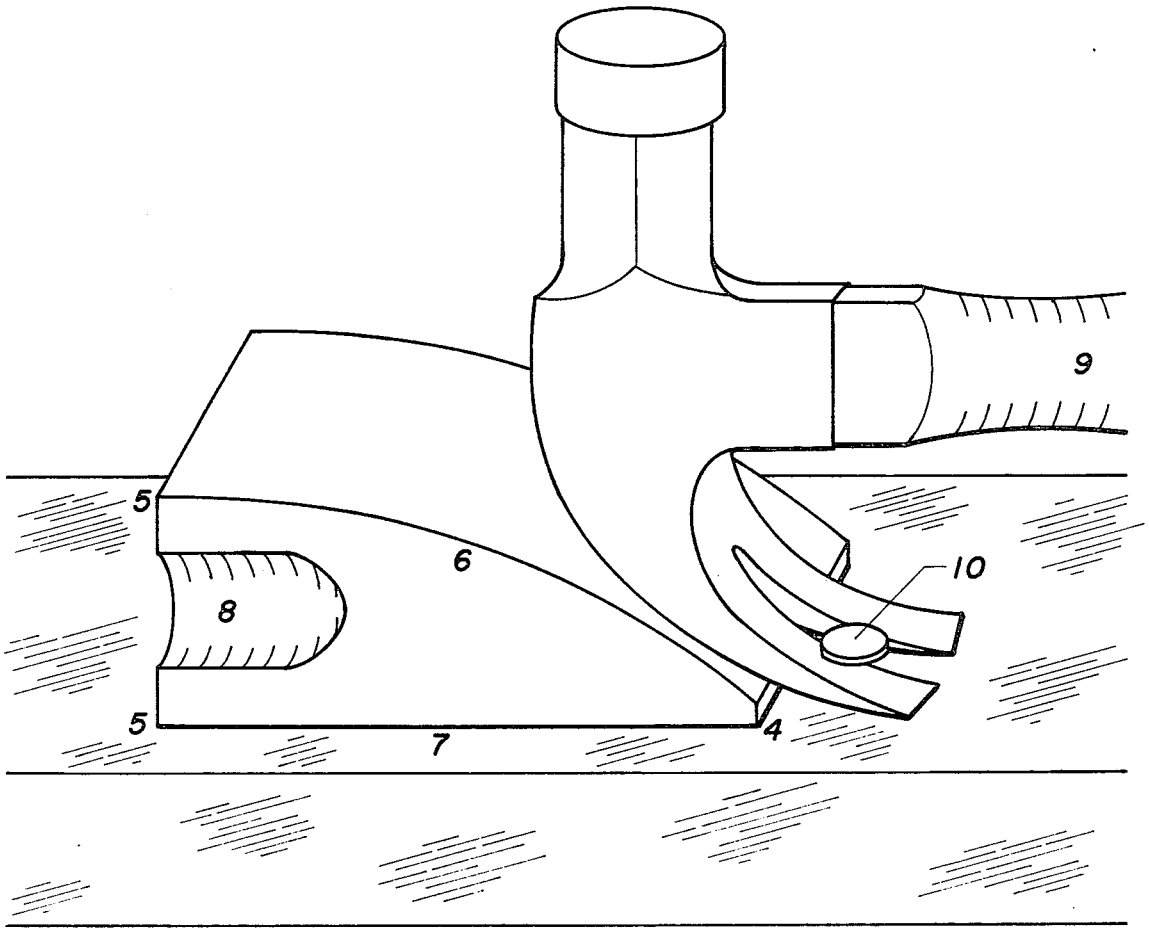
FIG. 2 is a planned view of the invention employed in the removal of a driven-in tack.
Figure 3:
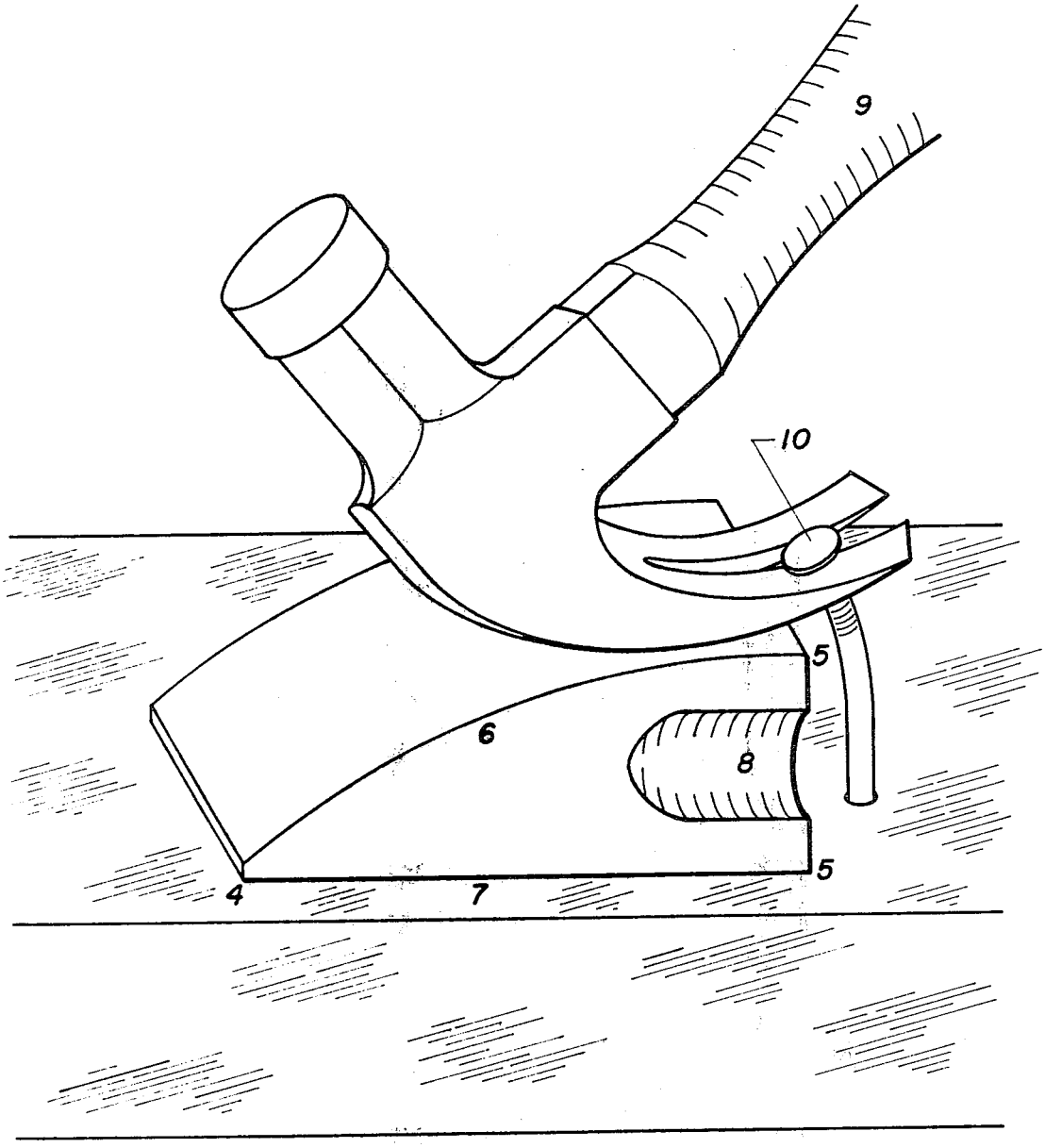
FIG. 3 is a planned view of the invention reversed for spike removal after the initial half way pulling have been accomplished.

Referring to the drawings FIGS. 1, 2, 3, the invention is there illustrated as applied to the manufacture of an easy pull clawed tool rest for removing nails, brads, tacks, spikes, etc. molded in one piece of 75 to 80 durometer neoprene rubber or comparable material of any color.

The rest shall be fashioned with a 4 inch base (7) with an arcked top surface (6) described by a portion of a 6 inch radius circle connecting the $1\frac{1}{2}$ inch vertical height (5) of one base (7) end to an $\frac{1}{8}$ inch height (4) at the opposite base (7) end. It shall be $1\frac{3}{4}$ inches in width of base (7) and surface (6), with indents (8) beginning midway from the $1\frac{1}{2}$ inch vertical height (5) and extending parallel to the base (7) toward the $\frac{1}{8}$ inch height end (4) for a length of $1\frac{1}{4}$ inches, said indents $\frac{3}{4}$ inch in width and $\frac{1}{4}$ inch in depth to serve as grip depressions for thumb and fingers of user. The surface of the rest shall be smoothly finished overall, reducing marring possibility to the maximum.

I claim:

1. A new and improved one-piece fulcrumming clawed tool rest, having neither openings nor appendages and being molded of solidly compact resilient material, to preclude wearing without reinforcement while at the same time minimizing marring in use and being configured with smoothly gripping flat base in measurement two and two-thirds times in horizontal longitude the vertical height of the right-angled heel, the extremities of said base and heel connected by a portion of six-inch circle to create an arcuate top-surfaced, generally rectangular in cross section fulcrumming rest, said rest employing on each of its two sides a grip depression indent beginning midway of heel height and running parallel to the base toward its acute angled junction with the top arcuate surface and measuring one-fourth inch less than the heel height in longitude, one-fourth inch in concavity, and one-half heel height in width; the hereinbefore described fulcrumming clawed tool rest with base resting against work surface providing without assembly or disassembly fulcrumming leverage for all clawed tools in the pulling and removal of shorter carpentry fasteners, specifically nails, tacks, brads, etc., when said tool claws are inserted beneath the fastener's head or cross member and the arcuate clawed tool section is rolled up the rest's arcuate surface and providing fulcrumming leverage in the completion of longer carpentry fastener removal, specifically longer nails, spike nails, etc., when the rest is reversed to place the heel in close proximity to the partially pulled fastener and the arcuate clawed tool section is rolled down the rest's arcuate section.

* * * * *